US005577353A

United States Patent [19]

Simpson

[11] Patent Number: 5,577,353

[45] Date of Patent: Nov. 26, 1996

[54] STEEL FRAME BUILDING SYSTEM AND TRUSS ASSEMBLY FOR USE THEREIN

[76] Inventor: William G. Simpson, P.O. Box 87, Columbus, Kans. 66725

[21] Appl. No.: 379,135

[22] Filed: Jan. 27, 1995

[51] Int. Cl.[6] ..... E04C 3/04; E04B 7/02

[52] U.S. Cl. ..... 52/92.2; 52/92.3; 52/93.1; 52/696; 52/656.9; 52/655.1; 52/639; 52/712; 403/170

[58] Field of Search ..... 52/92.2, 93.1, 52/93.2, 90.1, 634, 639, 653.1, 655.1, 656.9, 696, 654.1, 645, 650.2, 690, 693, 692, 712; 403/169, 170, 217

[56] References Cited

U.S. PATENT DOCUMENTS

| | | | |
|---|---|---|---|
| 584,640 | 6/1897 | Gronau . | |
| 1,369,837 | 3/1921 | Price | 403/169 X |
| 1,532,695 | 4/1925 | Harting | 52/63 X |
| 1,585,897 | 5/1926 | Davidson | 52/643 X |
| 1,654,480 | 12/1927 | Fuller . | |
| 2,365,175 | 12/1944 | Crawford . | |
| 2,541,784 | 2/1951 | Shannon | 52/92.2 |
| 2,840,014 | 6/1958 | Wadsworth et al. | 52/639 |
| 2,868,146 | 1/1959 | MacIntosh | 52/639 |
| 2,989,154 | 6/1961 | Colby | 52/653.1 |
| 3,149,708 | 9/1964 | Forse | 52/31 X |
| 3,309,120 | 3/1967 | Wada | 52/93.1 X |
| 3,466,828 | 9/1969 | November | 52/235 X |
| 4,315,386 | 2/1982 | Clarke . | |
| 4,342,177 | 8/1982 | Smith . | |
| 4,435,940 | 3/1984 | Davenport et al. . | |
| 4,616,453 | 10/1986 | Sheppard, Jr. et al. . | |
| 4,688,358 | 8/1987 | Madray . | |
| 4,773,192 | 9/1988 | Andrews . | |
| 4,982,545 | 1/1991 | Stromback . | |
| 4,988,232 | 1/1991 | Mason . | |
| 5,133,162 | 7/1992 | Nelson . | |
| 5,419,089 | 5/1995 | Hill | 52/93.2 |

FOREIGN PATENT DOCUMENTS

| | | | |
|---|---|---|---|
| 1238435 | 7/1960 | France | 52/93.2 |

*Primary Examiner*—Robert Canfield
*Attorney, Agent, or Firm*—William R. Sharp

[57] ABSTRACT

A steel building system, of the type having multiple frames, has at least one truss frame comprising a pair of column steel members, a bottom chord having at least one steel member, two top chord steel members, and at least one brace connected between the top chords and the bottom chord. Connecting plates are provided to connect the various steel members together. Such connecting plates have hole patterns which are juxtaposed with "standard" hole patterns near the ends of the steel members.

19 Claims, 3 Drawing Sheets

STEEL FRAME BUILDING SYSTEM AND TRUSS ASSEMBLY FOR USE THEREIN

According to one aspect of the invention, such invention relates to a steel frame building system. According to another aspect, the invention relates to a truss assembly which can be used in the steel frame building system.

There has long been a need in the steel building industry for steel frame building systems capable of on-site assembly without requiring any on-site fabrication (i.e. steel cutting) or welding. In particular, it is desirable that such steel building systems use standard light gauge (i.e. 12–16 gauge) steel members, manufactured by steel building component manufacturers, which are inexpensive and light-weight. One attempt to address this need is the subject of U.S. Pat. No. 4,342,177 of Smith. Although the building system disclosed in this patent can be assembled on the job site and uses light gauge steel members, this system has several distinct disadvantages discussed below.

The steel frame building system of the Smith patent includes multiple frames, including at least a pair of end frames and an intermediate frame. Each of the frames includes a pair of columns and a pair of "beams", where the column-beam connections are provided by haunch plates and associated stiffener angles and beam-beam connections are provided by ridge plates and associated stiffener angles. The stiffener angles, which are required to adequately reinforce their corresponding connections, are secured to respective light gauge C-channel steel members at a ridge or haunch by means of bolts through flanges of the steel members.

In order for the building to have adequate strength for the desired spacing between frames and the desired building widths, the intermediate frames of the Smith patent building system must have back to back steel members, undesirably contributing to the cost of the building. In addition, connection of the stiffener angles to the steel members requires holes through the flanges which must be drilled in a time consuming operation in the field or punched in an "off-line" operation by the manufacturer of the steel member, further contributing to the cost and/or difficulty of assembly. Standard hole patterns in the web of a steel member are more conveniently and inexpensively punched by the manufacturer in a standard "on-line" operation.

SUMMARY OF THE INVENTION

It is, therefore, an object of the invention to provide a steel frame building system capable of convenient on-site assembly using light gauge steel members as components of the frames, and which also: does not require back to back steel members for intermediate frames of the bulding; and does not require stiffener angles and associated holes in flanges of steel members.

The above object is realized by a steel frame building system of the type having multiple steel frames spaced along the length of the building and constructed from a plurality of elongated steel members, the improvement wherein each steel member has a longitudinal axis, opposing ends lying in respective planes substantially perpendicular to such longitudinal axis, and a hole pattern near each end comprising at least a pair of holes with each hole of each hole pair lying on an opposite side on of said longitudinal axis and lying along a line substantially perpendicular to said longitudinal axis, and further wherein at least one of the frames is a truss frame comprising: a substantially vertically oriented first column comprising a steel member; a substantially vertically oriented second column comprising a steel member; a substantially horizontally oriented bottom chord having a center and comprising at least one steel member which has a first end closely adjacent to the upper end of the first column steel member and a second end closely adjacent to the upper end of the second column steel member; a first top chord comprising a steel member which has a lower end closely adjacent to the upper end of the first column steel member and the first end of the bottom chord steel member(s), and which further has an upper end positioned substantially vertically above the center of the bottom chord; a second top chord comprising a steel member which has a lower end closely adjacent to the upper end of the second column steel member and the second end of the bottom chord steel member(s), and which further has an upper end closely adjacent to the upper end of the first top chord steel member; at least one brace comprising at least one steel member fixedly connected between the top chords and the bottom chord; a first haunch connecting plate having a first haunch hole pattern and positioned such that holes of the hole pattern near the lower end of the first top chord steel member, holes of the hole pattern near the first end of the bottom chord steel member(s), and holes of the hole pattern near the upper end of the first column steel member are juxtaposed with corresponding holes of the first haunch hole pattern; a plurality of first haunch fasteners received through respective first haunch juxtaposed holes so as to fixedly connect the first haunch connecting plate to the first top chord steel member near its lower end, the bottom chord steel member(s) near its first end, and the first column steel member near its upper end; a second haunch connecting plate and associated fasteners similar to the first haunch connecting plate and associated fasteners, such second haunch connecting plate being fixedly connected with its associated fasteners to the second top chord steel member near its lower end, the bottom chord steel member(s) near its second end, and the second column steel member near its upper end; a peak connecting plate having a peak hole pattern and positioned such that holes of the hole pattern near the upper end of the first top chord steel member and holes of the hole pattern near the upper end of the second top chord steel member are juxtaposed with holes of the peak hole pattern; a plurality of peak fasteners received through respective peak juxtaposed holes so as to fixedly connect the peak connecting plate to the first top chord steel member near its upper end and the second top chord steel member near its upper end.

According to another aspect of the invention, there is provided a truss assembly comprising the above-described top chords, bottom chord, at least one brace, and associated connecting plates and fastneners, wherein: each of the steel members comprises a web lying in a substantially vertical plane and a pair of flanges on opposite sides of and at right angles to the web, the hole patterns near the ends of the steel members being in the webs and the webs being substantially coplanar; and the bottom chord comprises a first bottom chord steel member extending from one end thereof (being the above-mentioned first end) to its other end near or at the center of the bottom chord, and further comprises a second bottom chord steel member extending from one end thereof near or at the center of the bottom chord to its other end (being the above-mentioned second end). The two bottom chord steel members are connected by a connecting plate herein referred to as a bottom center connecting plate.

Preferably, the truss frame of the steel building system of this invention is an intermediate frame positioned between two end frames. Such an intermediate truss frame does not require back to back steel members. Although the truss frame of the invention does employ a bottom chord and at least one brace, it still requires less materials than the back to back intermediate frame construction of the above-described Smith patent. Stiffener angles are further not required in conjunction with the connecting plates, thus eliminating the need for flange holes to connect steel members to the stiffener angles. Therefore, the invention takes full advantage of standard hole patterns in the webs of the steel members so as to minimize cost and/or difficulty of assembly.

According to a preferred embodiment of the invention, at least one of the end frames employs columns and top chords connected by connecting brackets. The connecting brackets, like the above-described connecting plates, utilize the standard hole patterns in the webs of the steel members and do not have associated stiffener angles.

DETAILED DESCRIPTION OF THE DRAWINGS

A preferred embodiment of the invention will now be described with reference to the drawings.

Figure 1:
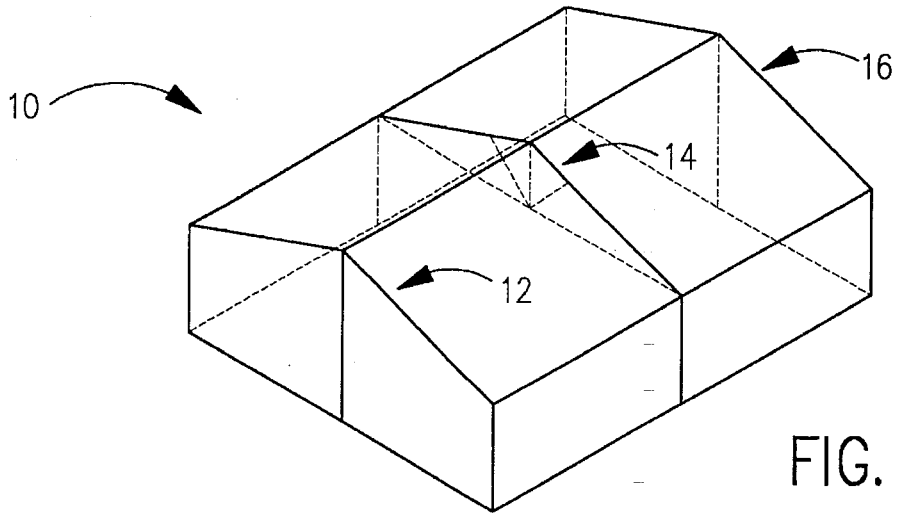
FIG. 1 is a schemeatic representation of a building having a pair of end frames and an intermediate truss frame in accordance with the invention.

Referring to FIG. 1, this schematic illustration shows a building 10 of the type having multiple steel frames spaced along the length of the building. FIG. 1 illustrates only the general shape of building 10 and the relative positioning of the frames, but omits structural details such as purlins, girts, etc. The frames include a first end frame 12, an intermediate frame 14, and a second end frame 16. The structure of these frames is described further below with reference to FIGS. 2 and 3. In particular, intermediate frame 14 is a "truss" frame. Preferred dimensions include a frame width of about 20–40 feet, a frame height of up to about 20 feet, and bay lengths (spacing between frames) of about 20–25 feet. The preferred roof pitch is 2⁴⁄₁₂, most preferably ³⁄₁₂.

Each of the frames is constructed from a plurality of elongated steel members, preferably cold-rolled and light gauge (i.e. 12, 14, or 16 gauge) C-channel steel stock having a tensile strength of 36,000–50,000 psi. The depth of any particular steel member depends upon its load bearing requirements. Typical depths are in the range of 4–12 inches. As will be apparent from FIGS. 2–9, each steel member has at each of its opposing ends a two hole ("single span") or four hole ("short lap") hole pattern which are standard in the industry in their dimensions and distance (1¾ inch) from corresponding ends. The connecting plates and connecting brackets which connect the various steel members of the frames are preferably ¼ inch plate steel. Fasteners for connecting steel members through the connecting plates and brackets are preferably hard steel (i.e. A325) bolts and associated nuts.

Figure 2:
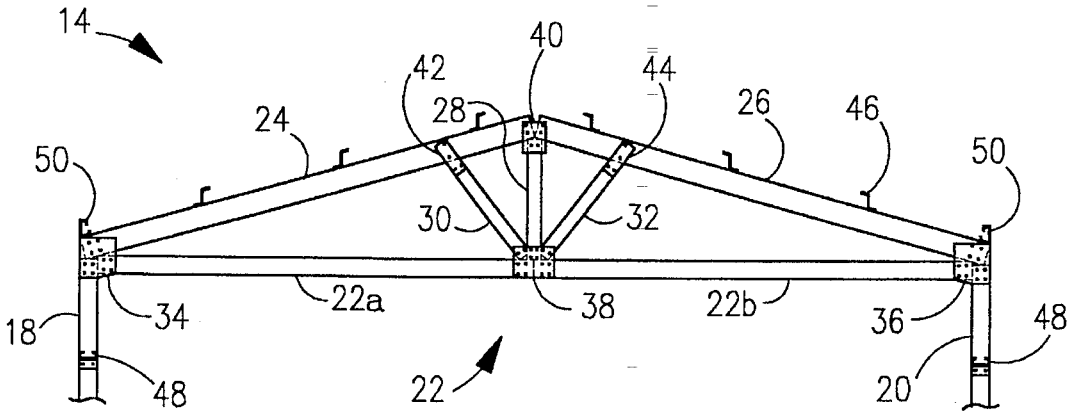
FIG. 2 is a view of the intermediate truss frame.

Referring now to FIG. 2, the illustated truss frame 14 has the following basic structural units: a substantially vertically oriented left column comprising a steel member 18; a substantially vertically oriented right column comprising a steel member 20; a substantially horizontally oriented bottom chord 22 comprising a first steel member **22*a* and a second steel member 22*b*, wherein bottom chord steel member 22*a* extends from a left end, closely adjacent to the upper end of the column steel member 18, to a right end near or at the center of bottom chord 22, and further wherein bottom chord steel member 22*b* extends from a left end near or at the center of bottom chord 22 to a right end closely adjacent to the upper end of column steel member 20; a left top chord comprising a steel member 24 which has a lower end closely adjacent to the upper end of column steel member 18 and the left end of bottom chord steel member 22*a*, and which further has an upper end positioned substantially vertically above the center of bottom chord 22; and a right top chord comprising a steel member 26 which has a lower end closely adjacent to the upper end of column steel member 20 and the right end of bottom chord steel member 22*b*, and which further has an upper end closely adjacent to the upper end of top chord steel member 24**.

Braces are provided in truss frame 14 as follows. A substantially vertically oriented steel member, vertical brace steel member 28, has a lower end closely adjacent to the center of the bottom chord 22 and an upper end closely adjacent to the upper ends of the top chord steel members 24 and 26. A first diagonally oriented steel member, diagonal brace steel member 30, has an upper end closely adjacent to the top chord steel member 24 at a position intermediate to its upper and lower ends, and further has a lower end closely adjacent to the lower end of vertical brace steel member 28. A second diagonally oriented steel member, diagonal brace steel member 32, has an upper end closely adjacent to top chord steel member 26 at a position intermediate to its upper and lower ends, and further has a lower end closely adjacent to the lower end of vertical brace steel member 28.

Figure 4:
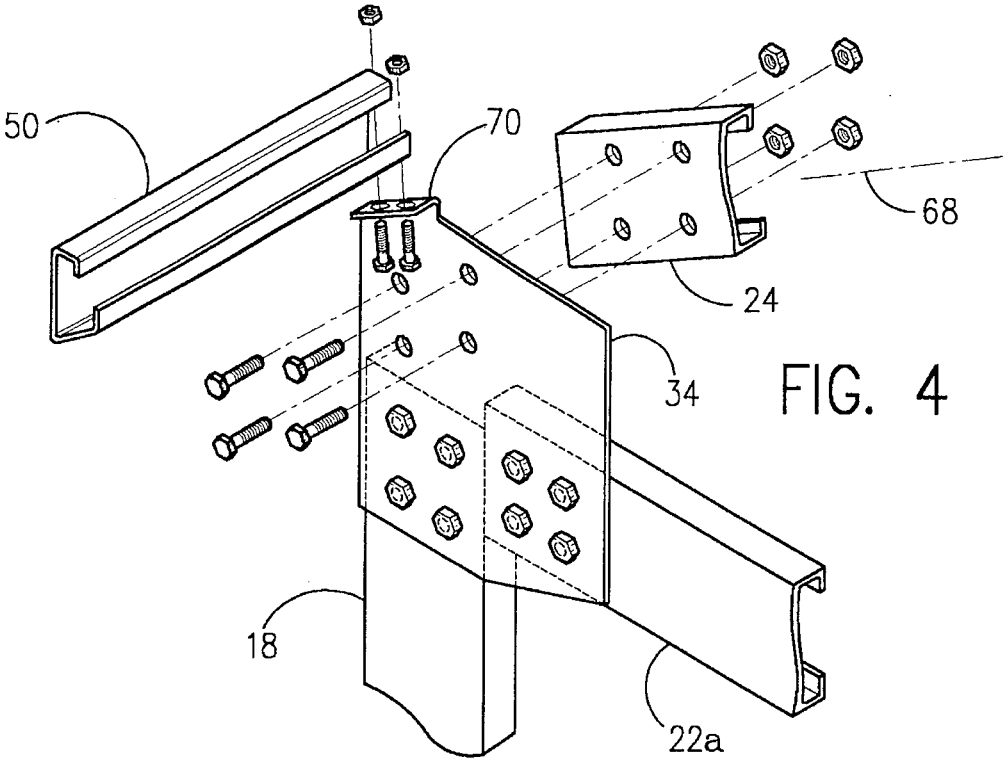
FIG. 4 is a close-up, perspective view of a haunch connection of the truss frame which is shown as partially disassembled.

As will be more apparent from the perspective yew of FIG. 4, back to back steel member construction is not required in truss frame 14; that is, the steel members illustrated in FIG. 2 are the only steel members of truss frame 14.

Various connecting plates are provided to connect the steel members shown in FIG. 2 as is discussed below. As should be apparent from FIG. 2, each such connecting plate provides the only structural connection between steel members connected by such connecting plate. In addition, each connecting plate has substantially flat opposing surfaces lying in respective vertical planes.

Haunch connecting plate 34 is fixedly connected to top chord steel member near its lower end, bottom chord steel member **22*a* near its left end, and column steel member near its upper end. Similarly, haunch connecting plate 36 is fixedly connected to top chord steel member 26 near its lower end, bottom chord steel member near its right end, and column steel member 20** near its upper end.

Bottom center connecting plate 38 is fixedly connected to bottom chord steel member **22*a* near its right end, bottom chord steel member 22***b* near its left end, vertical brace steel member near its lower end, diagonal brace steel member 30 near its lower end, and diagonal brace steel member 32 near its lower end.

Peak connecting plate 40 is fixedly connected to top chord steel member 24 and top chord steel member 26 near their respective upper ends. Intermediate connecting plate 42 is fixedly connected to diagonal brace steel member 30 near its upper end and to top chord steel member 24 between its ends. Similarly, intermediate connecting plate 44 is fixedly connected to diagonal brace steel member 32 near its upper end and to top chord steel member 26 between its ends.

Also shown in FIG. 2 are purlins 46, which are fixedly connected to the top chord steel members by suitable means, such as self-drilling screws. Girts 48 are fixedly connected to the column steel members by suitable means, such as brackets and associated self-drilling screws. The self-drilling screws are easily and quickly screwed into the steel using a standard drill with a suitable attachment or by using a screw gun. Eave struts 50 are fixedly connected to the haunch connecting plates with bolts and associated nuts in a manner shown in more detail in FIG. 4.

Figure 3:
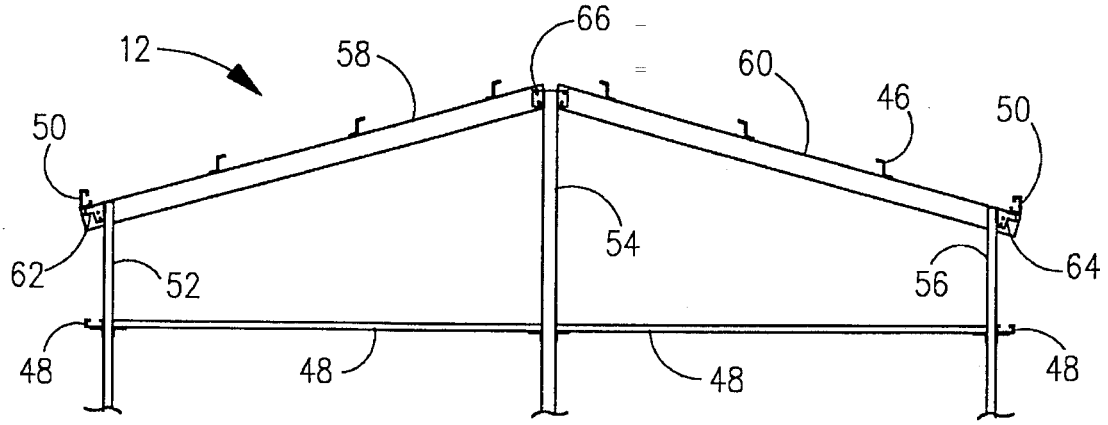
FIG. 3 is a view of one of the end frames.

Referring now to FIG. 3, end frame 12 is shown as having the following basic structural units: a left column comprising a steel member 52; an intermediate column comprising a steel member 54; a right column comprising a steel member 56; a left top chord comprising a steel member 58 which has a lower end closely adjacent to the upper end of column steel member 52 and an upper end closely adjacent to the upper end of column steel member 54; and a right top chord comprising a steel member 60 which has a lower end closely adjacent to the upper end of column steel member 56 and an upper end closely adjacent to the upper end of column steel member 54. It can be seen from FIG. 3, in conjunction with FIG. 2, that purlins 46, girts 48, and eave struts 50 extend between end frame 12 and intermediate truss frame 14.

Connecting brackets are provided to connect the various steel members of end frame 12 as is discussed below. As should be apparent from FIG. 3, each such connecting bracket provides the only structural connection between the steel members connected by such connecting bracket.

Corner connecting bracket 62 is fixedly connected to column steel member 52 near its upper end and to top chord steel member 58 near its lower end. Similarly, corner connecting bracket 64 is fixedly connected to column steel member 56 near its upper end and to top chord steel member 60 near its lower end. Peak connecting bracket 66 is fixedly connected to column steel member 54 near its upper end, top chord steel member 58 near its upper end, and top chord steel member 60 near its upper end.

Although the lower portions of the column steel members are not shown in FIGS. 2 and 3, it should be understood that the lower ends of such steel members are connected to a base, preferably a concrete slab, by a suitable bracket and bolts.

Referring now to FIG. 4, this close-up, partially disassembled view of the left haunch connection of FIG. 2 illustrates the manner in which column steel member 18, bottom chord steel member 22*a*, top chord steel member 24, and eave strut 50 are connected to haunch connecting plate 34. FIG. 4 also more clearly shows the preferred shape and structure of the steel members. With respect to top chord steel member 24, by way of example, such steel member can be seen to have a web extending along longitudinal axis 68, flanges on opposite sides of and at right angles to the web, and lips extending from the flanges at right angles to such flanges. The flanges are typically about 3 inches wide, and the lips are typically about ½ inch. The illustrated lower end of top chord member 24 can be seen to lie in a plane which is substantially perpendicular to longitudianl axis 68. The hole pattern near the lower end of top chord steel member 24 is a "short lap" pattern consisting of two pairs of holes, where each pair lies along a line substantially perpendicular to longitudinal axis 68. Each of the steel members of truss frame 14, as well as end frame 12, are identical in structure to top chord steel member 24 as described and illustrated, except that some steel members have "single span" hole patterns consisting of only one pair of holes.

It should further be apparent from FIG. 4 that the webs of steel members 18, 22*a*, and 24 are substantially coplanar. The webs of the other steel members of intermediate truss frame 14 are also substantially coplanar with each other as well as the webs of steel members 18, 22*a*, and 24.

FIG. 4 shows the manner in which the hole pattern near the lower end of top chord steel member 24 is juxtaposed with the top four holes of the hole pattern of haunch connecting plate 34. Bolts are received through such juxtaposed holes so as to fixedly connect haunch plate 34 to top chord steel member 24 near its lower end with associated nuts. Similarly, holes of the hole patterns near the respective upper and left ends of column steel member 18 and bottom chord steel member 22*a* are juxtaposed with corresponding holes of the hole pattern of haunch plate 34; and bolts are received through such juxtaposed holes (shown by broken lines) to fixedly connect, with associated nuts (not shown), the haunch connecting plate 34 to column steel member 18 near its upper end and the bottom chord steel member 22*a* near its left end.

As further shown by FIG. 4, haunch plate 34 has a flange 70 extending therefrom for fixedly connecting eave strut 50 to haunch connecting plate 34 by means of bolts and associated nuts.

A close-up view of the right haunch connection in FIG. 2 is not shown, but is understood to be like the left haunch connection.

Figure 5:
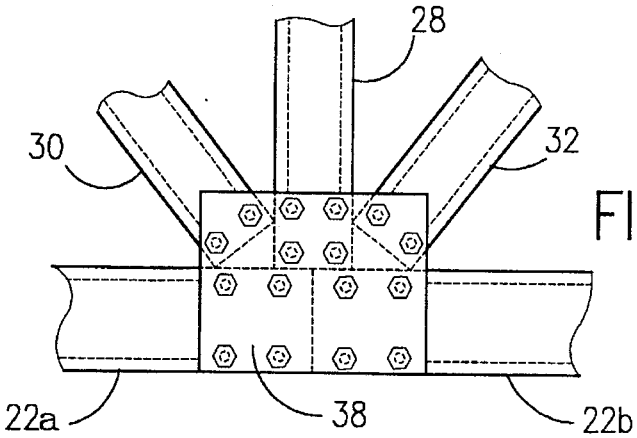
FIG. 5 is a close-up view of a bottom center connection of the truss frame.

Referring now to FIG. 5, this FIGURE is a close-up view of the bottom center connection wherein holes of the hole pattern near the right end of bottom chord 22*a*, holes of the hole pattern near the left end of bottom chord 22*b*, holes of the hole pattern near the lower end of vertical brace steel member 28, holes of the hole pattern near the lower end of diagonal brace steel member 30, and holes of the hole pattern near the lower end of diagonal brace steel member 32 are juxtaposed with corresponding holes of the hole pattern of bottom center connecting plate 38. Bolts are received through such juxtaposed holes so as to fixedly connect, in association with nuts (not shown), bottom center connecting plate 38 to bottom chord steel member 22*a* near its right end, bottom chord steel member 22*b* near its left end, vertical brace steel member 28 near its lower end, diagonal brace steel member 30 near its lower end, and diagonal brace steel member 32 near its lower end.

Figure 6:
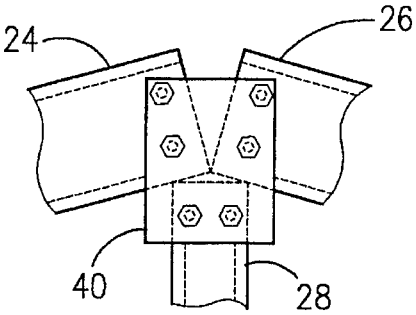
FIG. 6 is a close-up view of a peak connection of the truss frame.

Referring to FIG. 6, this FIGURE shows a close-up view of the peak connection for truss frame 14 wherein holes of the hole patterns near the upper ends of top chord steel members 24 and 26 and holes of the hole pattern near the upper end of vertical brace steel member 28 are juxtaposed with corresponding holes of the hole pattern of peak connecting plate 40. Bolts are received through such juxtaposed holes so as to fixedly connect, in association with nuts (not shown), peak connecting plate 40 to vertical brace steel member 28 near its upper end, top chord steel member 24 near its upper end, and top chord steel member 26 near its upper end.

Figure 7:
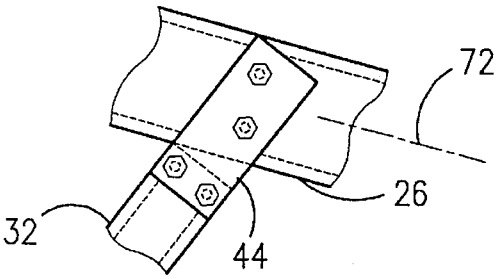
FIG. 7 is a close-up view of an intermediate connection of the truss frame.

Referring now to FIG. 7, this close-up view of the right intermediate connection shows a hole pattern comprising a pair of holes in the web of top chord steel member 26 and between its ends, such hole pattern being juxtaposed with a corresponding pair of holes of a hole pattern in diagonal brace steel member 44. The pair of holes in top chord steel member 26 are positioned with respect to longitudinal axis 72 of top chord steel member 26 so as to be on opposite sides of such axis and so as to lie along a line substantially perpendicular to such axis. Another pair of holes of the hole pattern of intermediate connecting plate 44 are juxtaposed with holes of the hole pattern near the upper end of diagonal brace steel member 32. Bolts are received through corresponding juxtaposed holes so as to fixedly connect, with associated nuts (not shown), intermediate connecting plate 44 to top chord steel member 26 at a position between its ends and to diagonal brace steel member 32 near its upper end.

Figure 8:
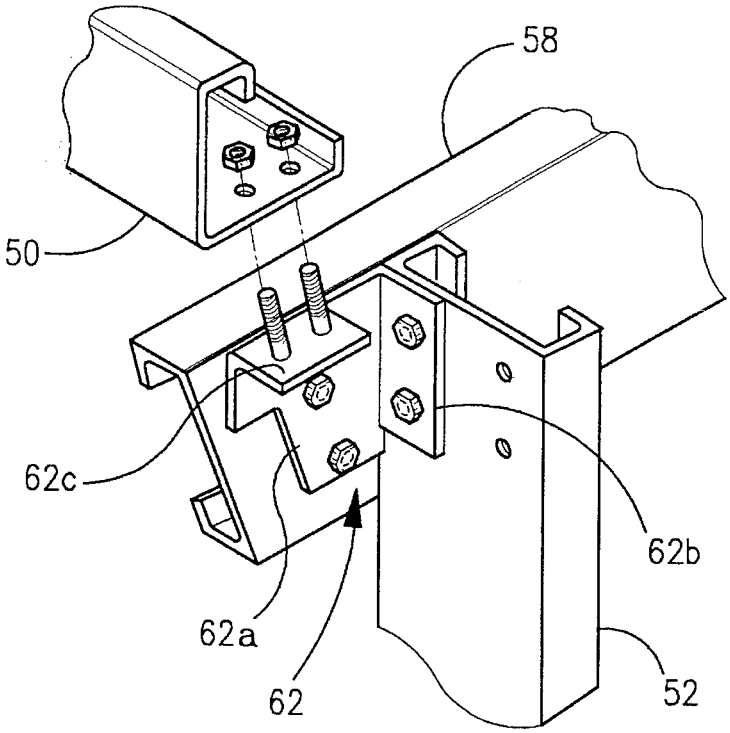
FIG. 8 is a close-up, perspective view of a corner connection of the end frame which is shown as partially disassembled.

Referring now to FIG. 8, this close-up, partially disassembled view of the left corner connection of FIG. 3 shows corner connecting bracket 62 as having a first portion 62*a* and a second portion 62*b* substantially perpendicular to first portion 62*a*. Holes of the hole pattern of first portion 62*a* are juxtaposed with holes of the hole pattern near the lower end of top chord steel member 58, and holes of the hole pattern of second portion 62*b* are juxtaposed with two holes of the hole pattern near the upper end of column steel member 52. Bolts are received through such juxtaposed holes so as fixedly connect, with associated nuts (not shown), corner connecting bracket 62 to top chord steel member 58 near its lower end and to column steel member 52 near its upper end. Corner connecting bracket 62 further has a flange 62*c* extending therefrom for fixedly connecting corner connecting bracket 62 to eave strut 50 by means of bolts and associated nuts.

It is understood that the right corner connection in FIG. 3 is like the corner connection shown in FIG. 8.

Figure 9:
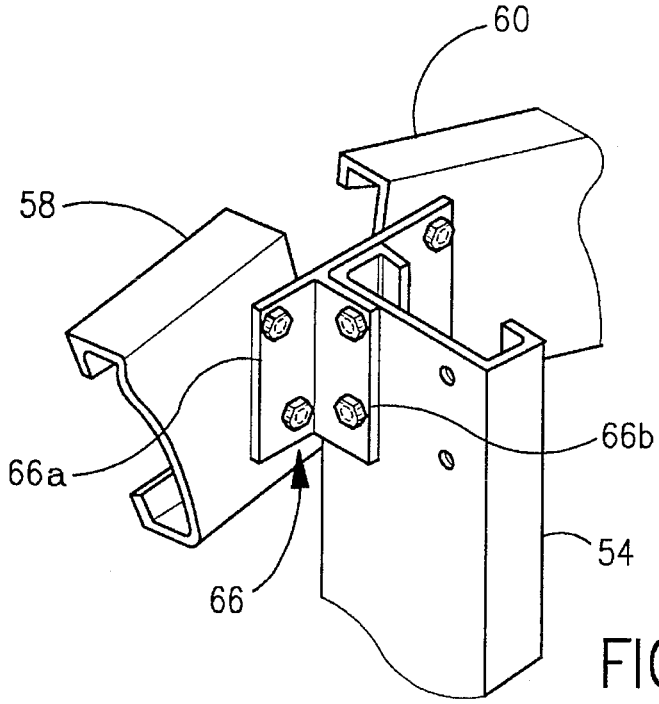
FIG. 9 is a close-up, perspective view of a peak connection of the end frame.

Referring now to FIG. 9, this close-up view of the peak connection in end frame 12 shows peak connecting bracket 66 as having a first portion 66*a* and a second portion 66*b* substantially perpendicular to first portion 66*a*. The hole pattern of first portion 66*a* has one pair of holes juxtaposed with the hole pattern near the upper end of top chord steel member 58, and further has another pair of holes (only one of which is visible in FIG. 9) juxtaposed with the hole pattern near the upper end of top chord steel member 60. Second portion 66*b* has a hole pattern juxtaposed with two holes of the hole pattern near the upper end of column steel member 54. Bolts are received through the juxtaposed holes of this peak connection so as to fixedly connect, with associated nuts (not shown), peak connecting plate 66 to column steel member 54 near its upper end and to top chord steel members 58 and 60 near their respective upper ends.

It can be seen from FIGS. 8 and 9, as well as from FIG. 3, that the webs of column steel members 52, 54, and 56 are substantially parallel to one another but substantially perpendicular to the webs of top chord steel members 58 and 60, which are substantially coplanar.

The steel building system comprising the end frames and at least one truss frame as described above can be assembled in any convenient order. Once the frames, eave struts, purlins, and girts are assembled and erected, suitable wall and roofing material, such as corrugated steel, can be secured into place to complete the building. Of course, doors and windows can be provided as desired.

Obviously, many modifications and variations of the present invention are possible in light of the above teachings. For example, according to certain broad aspects of the invention, the assembly of the top chords, bottom chord, and brace steel members shown in FIG. 2 (which can be denoted as a "truss assembly") could have its haunch connecting plates connected to support columns of a material other than steel. Conventional wooden columns could be used as long as they could bear the vertical loads. It is, therefore, to be understood that within the scope of the appended claims, the invention may be practiced otherwise than as specifically described.

That which is claimed is:

1. A steel frame building system, for use in a building, of the type having multiple steel frames spaced along the length of the building and constructed from a plurality of elongated steel members, the improvement wherein each steel member has a longitudinal axis, opposing ends lying in respective planes substantially perpendicular to said longitudinal axis, and a hole pattern near each end comprising at least a pair of holes with each hole of each hole pair lying on an opposite side of said longitudinal axis and lying along a line substantially perpendicular to said longitudinal axis, and further wherein at least one of the frames is a truss frame comprising:

a substantially vertically oriented first column comprising a steel member which has a lower end and an upper end;

a substantially vertically oriented second column comprising a steel member which has a lower end and an upper end;

a substantially horizontally oriented bottom chord having a center and comprising at least one steel member which has a first end closely adjacent to the upper end of the first column steel member and a second end closely adjacent to the upper end of the second column steel member;

a first top chord comprising a steel member which has a lower end closely adjacent to the upper end of the first column steel member and the first end of said at least one bottom chord steel member, and which further has an upper end positioned substantially vertically above the center of the bottom chord;

a second top chord comprising a steel member which has a lower end closely adjacent to the upper end of the second column steel member and the second end of said at least one bottom chord steel member, and which further has an upper end closely adjacent to the upper end of the first top chord steel member;

at least one brace comprising at least one steel member fixedly connected between the top chords and the bottom chord;

a first haunch connecting plate having a first haunch hole pattern and positioned such that holes of the hole pattern near the lower end of the first top chord steel member, holes of the hole pattern near the first end of said at least one bottom chord steel member, and holes of the hole pattern near the upper end of the first column steel member are juxtaposed with corresponding holes of the first haunch hole pattern, such juxtaposed holes being hereafter referred to as first haunch juxtaposed holes;

a plurality of first haunch fasteners received through respective first haunch juxtaposed holes so as to fixedly connect the first haunch connecting plate to the first top chord steel member near its lower end, said at least one bottom chord steel member near its first end, and the first column steel member near its upper end;

a second haunch connecting plate having a second haunch hole pattern and positioned such that holes of the hole pattern near the lower end of the second top chord steel member, holes of the hole pattern near the second end of said at least one bottom chord steel member, and holes of the hole pattern near the upper end of the second column steel member are juxtaposed with corresponding holes of the second haunch hole pattern, such juxtaposed holes being hereafter referred to as second haunch juxtaposed holes;

a plurality of second haunch fasteners received through respective second haunch juxtaposed holes so as to fixedly connect the second haunch connecting plate to the second top chord steel member near its lower end, said at least one bottom chord steel member near its second end, and the second column steel member near its upper end;

a peak connecting plate having a peak hole pattern and positioned such that holes of the hole pattern near the upper end of the first top chord steel member and holes of the hole pattern near the upper end of the second top chord steel member are juxtaposed with holes of the peak hole pattern, such juxtaposed holes being hereafter referred to peak juxtaposed holes;

a plurality of peak fasteners received through respective peak juxtaposed holes so as to fixedly connect the peak connecting plate to the first top chord steel member near its upper end and the second top chord steel member near its upper end; and wherein each of the connecting plates provides the only structural connection between steel members connected thereby.

2. A steel frame building system as recited in claim 1 wherein each steel member of the steel building system comprises a web which extends along the longitudinal axis of said steel member, has the hole patterns therein near the ends of the steel member, and lies in a substantially vertical plane, each said steel member further comprising flanges on opposite sides of and at right angles to the web, and further wherein the webs of the truss frame steel members are substantially coplanar.

3. A steel frame building system as recited in claim 2 wherein each steel member of the frames is cold-rolled steel.

4. A steel frame building system as recited in claim 3 wherein said at least one steel bottom chord steel member comprises a first bottom chord steel member extending from one end, being said first end, to its other end near or at the center of the bottom chord, and further comprises a second bottom chord steel member substantially coaxial with the first bottom chord steel member and extending from one end near or at the center of the bottom chord to its other end, being said second end, said building system further comprising: a bottom center connecting plate having a bottom center hole pattern and positioned such that holes of the hole pattern near said other end of the first bottom chord steel member and holes of the hole pattern near said one end of the second bottom chord steel member are juxtaposed with corresponding holes of the bottom center hole pattern, such juxtaposed holes being hereafter referred to as bottom center juxtaposed holes; and a plurality of bottom center fasteners received through respective bottom center juxtaposed holes so as to fixedly connect the bottom center connecting plate to the first bottom chord steel member near said other end thereof and the second bottom chord steel member near said one end thereof.

5. A steel frame building system as recited in claim 4 wherein said at least one brace comprises a substantially vertically oriented steel member, denoted as a vertical brace steel member, having a lower end closely adjacent to the center of the bottom chord and an upper end closely adjacent to the upper ends of the first and second top chord steel members, and wherein holes of the hole pattern near the lower end of the vertical brace steel member are juxtaposed with corresponding holes of the bottom center hole pattern and holes of the hole pattern near the upper end of the vertical brace steel member are juxtaposed with corresponding holes of the peak hole pattern, said building system further comprising additional peak fasteners for fixedly connecting the peak connecting plate to the vertical brace steel member near the upper end thereof and additional bottom center fasteners for fixedly connecting the bottom center connecting plate to the vertical brace steel member near the lower end thereof.

6. A steel frame building system as recited in claim 5 wherein each of the first and second top chord steel members has a hole pattern in its web and between its ends comprising at least a pair of holes on opposite sides of its longitudinal axis and lying along a line substantially perpendicular to such longitudinal axis, and wherein said at least one brace further comprises: a first diagonally oriented steel member, denoted as a first diagonal brace steel member, having an upper end closely adjacent to the first top chord steel member at a position intermediate to the upper and lower ends of the first top chord steel member, and further having a lower end closely adjacent to the lower end of the vertical brace steel member, wherein holes of the hole pattern near the lower end of the first diagonal brace steel member are juxtaposed with corresponding holes of the bottom center hole pattern; additional bottom center fasteners for fixedly connecting the bottom center connecting plate to the first diagonal brace steel member near the lower end thereof; a first intermediate connecting plate having a first intermediate hole pattern and positioned such that holes of the hole pattern near the upper end of first diagonal brace steel member and holes of the hole pattern between ends of the first top chord steel member are juxtaposed with corresponding holes of the first intermediate hole pattern, such juxtaposed holes being being hereafter referred to as first intermediate juxtaposed holes; a plurality of first intermediate fasteners received through respective first intermediate juxtaposed holes so as to fixedly connect the first intermediate connecting plate to the first diagonal brace steel member near its upper end and to the first top chord steel member between its ends; a second diagonally oriented steel member, denoted as a second diagonal brace steel member, having an upper end closely adjacent to the second top chord steel member at a position intermediate to the upper and lower ends of the second top chord steel member, and further having a lower end closely adjacent to the lower end of the vertical brace steel member, wherein holes of the hole pattern near the lower end of the second diagonal brace steel member are juxtaposed with corresponding holes of the bottom center hole pattern; additional bottom center fasteners for fixedly connecting the bottom center connecting plate to the second diagonal brace steel member near the lower end thereof; a second intermediate connecting plate having a second intermediate hole pattern and positioned such that holes of the hole pattern near the upper end of second diagonal brace steel member and holes of the hole pattern between ends of the second top chord steel member are juxtaposed with corresponding holes of the second intermediate hole pattern, such juxtaposed holes being being hereafter referred to as second intermediate juxtaposed holes; a plurality of second intermediate fasteners received through respective second intermediate juxtaposed holes so as to fixedly connect the second intermediate connecting plate to the second diagonal brace steel member near its upper end and to the second top chord steel member between its ends.

7. A steel frame building system as recited in claim 6 wherein each of the connecting plates has substantially flat opposing surfaces lying in respective vertical planes.

8. A steel frame building system as recited in claim 7 wherein the first column steel member is the only steel member of the first column, the second column steel member is the only steel member of the second column, the first and second top chord steel members are the only steel members of the first and second top chords, the first and second bottom chord steel members of the bottom chord are the only steel members of the bottom chord, and the diagonal brace steel members and vertical brace steel member are the only brace steel members.

9. A steel frame building system as recited in claim 8 wherein each of the fasteners comprises a bolt and associated nut.

10. A steel frame building system of the type constructed of a plurality of elongated steel members and having end frames and at least one intermediate frame, wherein each steel member has a longitudinal axis, a web which extends along said longitudinal axis and which lies in a vertical plane, a pair of flanges on opposite sides of and at right angles to the web, opposing ends lying in respective planes substantially perpendicular to said longitudinal axis, and a hole pattern in the web and near each end comprising at least a pair of holes with each hole of each hole pair lying on an opposite side of said longitudinal axis and lying along a line substantially perpendicular to said longitudinal axis, and further wherein the steel frame building system comprises the following components of which (a)–(l) comprise a truss frame as said at least one intermediate frame and (m)–(w) comprise at least one of the end frames:

(a) a substantially vertically oriented first column comprising a steel member which has a lower end and an upper end;

(b) a substantially vertically oriented second column comprising a steel member which has a lower end and an upper end;

(c) a substantially horizontally oriented bottom chord having a center and comprising at least one steel member which has a first end closely adjacent to the upper end of the first column steel member and a second end closely adjacent to the upper end of the second column steel member;

(d) a first top chord comprising a steel member which has a lower end closely adjacent to the upper end of the first column steel member and the first end of said at least one bottom chord steel member, and which further has an upper end positioned substantially vertically above the center of the bottom chord;

(e) a second top chord comprising a steel member which has a lower end closely adjacent to the upper end of the second column steel member and the second end of said at least one bottom chord steel member, and which further has an upper end closely adjacent to the upper end of the first top chord steel member;

(f) at least one brace comprising at least one steel member fixedly connected between the top chords and the bottom chord;

(g) a first haunch connecting plate having a first haunch hole pattern and positioned such that holes of the hole pattern near the lower end of the first top chord steel member, holes of the hole pattern near the first end of said at least one bottom chord steel member, and holes of the hole pattern near the upper end of the first column steel member are juxtaposed with corresponding holes of the first haunch hole pattern, such juxtaposed holes being hereafter referred to as first haunch juxtaposed holes;

(h) a plurality of first haunch fasteners received through respective first haunch juxtaposed holes so as to fixedly connect the first haunch connecting plate to the first top chord steel member near its lower end, said at least one bottom chord steel member near its first end, and the first column steel member near its upper end;

(i) a second haunch connecting plate having a second haunch hole pattern and positioned such that holes of the hole pattern near the lower end of the second top chord steel member, holes of the hole pattern near the second end of said at least one bottom chord steel member, and holes of the hole pattern near the upper end of the second column steel member are juxtaposed with corresponding holes of the second haunch hole pattern, such juxtaposed holes being hereafter referred to as second haunch juxtaposed holes;

(j) a plurality of second haunch fasteners received through respective second haunch juxtaposed holes so as to fixedly connect the second haunch connecting plate to the second top chord steel member near its lower end, said at least one bottom chord steel member near its second end, and the second column steel member near its upper end;

(k) a peak connecting plate having a peak hole pattern and positioned such that holes of the hole pattern near the upper end of the first top chord steel member and holes of the hole pattern near the upper end of the second top chord steel member are juxtaposed with holes of the peak hole pattern, such juxtaposed holes being hereafter referred to as first peak juxtaposed holes;

(l) a plurality of first peak fasteners received through respective first peak juxtaposed holes so as to fixedly connect the peak connecting plate to the first top chord steel member near its upper end and the second top chord steel member near its upper end;

(m) a third column comprising a steel member which has a lower end and an upper end;

(n) a fourth column comprising a steel member which has a lower end and an upper end;

(o) a third top chord comprising a steel member which has a lower end closely adjacent to the upper end of the third column steel member and an upper end at substantially the same vertical position as the upper end of the first top chord steel member;

(p) a fourth top chord comprising a steel member which has a lower end closely adjacent to the upper end of the fourth column steel member and an upper end closely adjacent to the upper end of the third top chord steel member;

(q) a fifth column comprising a steel member which has a lower end and an upper end closely adjacent to the upper ends of the third and fourth top chord steel members, the web of the fifth column steel member as well as the webs of the third and fourth column steel members being substantially parallel to one another but substantially perpendicular to the webs of the third and fourth top chord steel members, which are substantially coplanar;

(r) a first corner connecting bracket having a first portion with holes of a first hole pattern which are juxtaposed with holes of the hole pattern near the lower end of the third top chord steel member, and further having a second portion, substantially perpendicular to the first portion, with holes of a second hole pattern which are juxtaposed with holes of the hole pattern near the upper end of the third column steel member, the juxtaposed holes associated with the first corner connecting bracket being hereafter referred to as first corner juxtaposed holes;

(s) a plurality of first corner fasteners received through respective first corner juxtaposed holes so as to fixedly connect the first corner connecting bracket to the third column steel member near its upper end and the third top chord steel member near its lower end;

(t) a second corner connecting bracket having a first portion with holes of a first hole pattern which are juxtaposed with holes of the hole pattern near the lower end of the fourth top chord steel member, and further having a second portion, substantially perpendicular to the first portion of the second corner connecting bracket, with holes of a second hole pattern which are juxtaposed with holes of the hole pattern near the upper end of the fourth column steel member, the juxtaposed holes associated with the second corner connecting bracket being hereafter referred to as second corner juxtaposed holes;

(u) a plurality of second corner fasteners received through respective second corner juxtaposed holes so as to fixedly connect the second corner connecting bracket to the fourth column steel member near its upper end and the fourth top chord steel member near its lower end;

(v) a peak connecting bracket having a first portion with holes of a hole pattern which are juxtaposed with holes of the hole pattern near the upper end of the third top chord steel member and holes of the hole pattern near the upper end of the fourth top chord steel member, the peak connecting bracket further having a second portion, substantially perpendicular to the first portion of the peak connecting bracket, with holes of a hole pattern which are juxtaposed with holes of the hole pattern near the upper end of the fifth column steel member, the juxtaposed holes associated with the peak connecting bracket being hereafter referred to as the second peak juxtaposed holes; and (w) a plurality of second peak fasteners received through respective second peak juxtaposed holes so as to fixedly connect the peak connecting bracket to the third top chord steel member near its upper end, the fourth top chord steel member near its upper end, and the fifth column steel member near its upper end.

11. A steel frame building system as recited in claim 10 wherein each connecting bracket provides the only structural connection between steel members connected thereby.

12. A steel frame building system as recited in claim 11 wherein the first haunch connecting plate has a first haunch flange extending therefrom, the first corner connecting bracket has a first corner flange extending therefrom, the second haunch connecting plate has a second haunch flange extending therefrom, and the second corner connecting plate has a second corner flange extending therefrom, said building system further comprising: a first eave strut extending between and fixedly connected to the first haunch flange and the first corner flange; and a second eave strut extending between and fixedly connected to the second haunch flange and the second corner flange.

13. A truss assembly of elongated steel members, wherein each steel member has a longitudinal axis and a web which extends along said longitudinal axis and which lies in a substantially vertical plane, a pair of flanges on opposite sides of and at right angles to the web, opposing ends lying in respective planes substantially perpendicular to said longitudinal axis, and a hole pattern in the web and near each end comprising at least a pair of holes with each hole of each hole pair lying on an opposite side of said longitudinal axis and lying along a line substantially perpendicular to said longitudinal axis, and further wherein the webs of the steel members are substantially coplanar, said truss assembly comprising:

a bottom chord having a center and comprising a first bottom chord steel member extending from one end thereof to its other end near or at the center of the bottom chord, and further comprising a second bottom chord steel member substantially coaxial with the first bottom chord steel member and extending from one end thereof near or at the center of the bottom chord to its other end;

a first top chord comprising a steel member which has a lower end closely adjacent to said one end of the first bottom chord steel member, and which further has an upper end positioned substantially vertically above the center of the bottom chord;

a second top chord comprising a steel member which has a lower end closely adjacent to said other end of the second bottom chord steel member, and which further has an upper end closely adjacent to the upper end of the first top chord steel member;

at least one brace comprising at least one steel member fixedly connected between the top chords and the bottom chord;

a first haunch connecting plate having a first haunch hole pattern and positioned such that holes of the hole pattern near the lower end of the first top chord steel member and holes of the hole pattern near said one end of the first bottom chord steel member are juxtaposed with corresponding holes of the first haunch hole pattern, such juxtaposed holes being hereafter referred to as first haunch juxtaposed holes;

a plurality of first haunch fasteners received through respective first haunch juxtaposed holes so as to fixedly connect the first haunch connecting plate to the first top chord steel member near its lower end and the first bottom chord steel member near said one end thereof;

a second haunch connecting plate having a second haunch hole pattern and positioned such that holes of the hole pattern near the lower end of the second top chord steel member and holes of the hole pattern near said other end of the second bottom chord steel member are juxtaposed with corresponding holes of the second haunch hole pattern, such juxtaposed holes being hereafter referred to as second haunch juxtaposed holes;

a plurality of second haunch fasteners received through respective second haunch juxtaposed holes so as to fixedly connect the second haunch connecting plate to the second top chord steel member near its lower end and the second bottom chord steel member near said other end thereof;

a bottom center connecting plate having a bottom center hole pattern and positioned such that holes of the hole pattern near said other end of the first bottom chord steel member and holes of the hole pattern near said one end of the second bottom chord steel member are juxtaposed with corresponding holes of the bottom center hole pattern, such juxtaposed holes being hereafter referred to as bottom center juxtaposed holes;

a plurality of bottom center fasteners received through respective bottom center juxtaposed holes so as to fixedly connect the bottom center connecting plate to the first bottom chord steel member near said other end thereof and the second bottom chord steel member near said one end thereof;

a peak connecting plate having a peak hole pattern and positioned such that holes of the hole pattern near the upper end of the first top chord steel member and holes of the hole pattern near the upper end of the second top chord steel member are juxtaposed with holes of the peak hole pattern, such juxtaposed holes being hereafter referred to peak juxtaposed holes;

a plurality of peak fasteners received through respective peak juxtaposed holes so as to fixedly connect the peak connecting plate to the first top chord steel member near its upper end and the second top chord steel member near its upper end; and wherein each of the connecting plates provides the only structural connection between steel members connected thereby.

14. A truss assembly as recited in claim 13 wherein each steel member of the truss assembly is cold-rolled steel.

15. A truss assembly as recited in claim 12 wherein said at least one brace comprises a substantially vertically oriented steel member, denoted as a vertical brace steel member, having a lower end closely adjacent to the center of the bottom chord and an upper end closely adjacent to the upper ends of the first and second top chord steel members, and wherein holes of the hole pattern near the lower end of the vertical brace steel member are juxtaposed with corresponding holes of the bottom center hole pattern and holes of the hole pattern near the upper end of the vertical brace steel member are juxtaposed with corresponding holes of the peak hole pattern, said building system further comprising additional peak fasteners for fixedly connecting the peak connecting plate to the vertical brace steel member near the upper end thereof and additional bottom center fasteners for fixedly connecting the bottom center connecting plate to the vertical brace steel member near the lower end thereof.

16. A truss assembly as recited in claim 13 wherein each of the first and second top chord steel members has a hole pattern in its web and between its ends comprising at least a pair of holes on opposite sides of its longitudinal axis and lying along a line substantially perpendicular to such longitudinal axis, and wherein said at least one brace further comprises: a first diagonally oriented steel member, denoted as a first diagonal brace steel member, having an upper end closely adjacent to the first top chord steel member at a position intermediate to the upper and lower ends of the first top chord steel member, and further having a lower end closely adjacent to the lower end of the vertical brace steel member, wherein holes of the hole pattern near the lower end of the first diagonal brace steel member are juxtaposed with corresponding holes of the bottom center hole pattern; additional bottom center fasteners for fixedly connecting the bottom center connecting plate to the first diagonal brace steel member near the lower end thereof; a first intermediate connecting plate having a first intermediate hole pattern and positioned such that holes of the hole pattern near the upper end of first diagonal brace steel member and holes of the hole pattern between ends of the first top chord steel member are juxtaposed with corresponding holes of the first intermediate hole pattern, such juxtaposed holes being being hereafter referred to as first intermediate juxtaposed holes; a plurality of first intermediate fasteners received through respective first intermediate juxtaposed holes so as to fixedly connect the first intermediate connecting plate to the first diagonal brace steel member near its upper end and to the first top chord steel member between its ends; a second diagonally oriented steel member, denoted as a second diagonal brace steel member, having an upper end closely adjacent to the second top chord steel member at a position intermediate to the upper and lower ends of the second top chord steel member, and further having a lower end closely adjacent to the lower end of the vertical brace steel member, wherein holes of the hole pattern near the lower end of the second diagonal brace steel member are juxtaposed with corresponding holes of the bottom center hole pattern; additional bottom center fasteners for fixedly connecting the bottom center connecting plate to the second diagonal brace steel member near the lower end thereof; a second intermediate connecting plate having a second intermediate hole pattern and positioned such that holes of the hole pattern near the upper end of second diagonal brace steel member and holes of the hole pattern between ends of the second top chord steel member are juxtaposed with corresponding holes of the second intermediate hole pattern, such juxtaposed holes being being hereafter referred to as second intermediate juxtaposed holes; a plurality of second intermediate fasteners received through respective second intermediate juxtaposed holes so as to fixedly connect the second intermediate connecting plate to the second diagonal brace steel member near its upper end and to the second top chord steel member between its ends.

17. A truss assembly as recited in claim 16 wherein each of the connecting plates has substantially flat opposing surfaces lying in respective vertical planes.

18. A truss assembly as recited in claim 17 wherein each of the fasteners comprises a bolt and associated nut.

19. An assembly of elongated steel members, wherein each steel member has a longitudinal axis, a web which extends along said longitudinal axis and which lies in a substantially vertical plane, a pair of flanges on opposite sides of and at right angles to the web, opposing ends lying in respective planes substantially perpendicular to said longitudinal axis, and a hole pattern in the web and near each end comprising at least a pair of holes with each hole of each hole pair lying on an opposite side of said longitudinal axis and lying along a line substantially perpendicular to said longitudinal axis, the assembly comprising:

a first column comprising a steel member which has a lower end and an upper end;

a second column comprising a steel member which has a lower end and an upper end;

a first chord comprising a steel member which has a lower end closely adjacent to the upper end of the first column steel member, and which further has an upper end;

a second chord comprising a steel member which has a lower end closely adjacent to the upper end of the second column steel member, and which further has an upper end closely adjacent to the upper end of the first chord steel member;

a third column comprising a steel member which has a lower end and an upper end closely adjacent to the upper ends of the first and second chord steel members, the web of the third column steel member as well as the webs of the first and second column steel members being substantially parallel to one another but substantially perpendicular to the webs of the first and second chord steel members, which are substantially coplanar;

a first corner connecting bracket having a first portion with holes of a first hole pattern which are juxtaposed with holes of the hole pattern near the lower end of the first chord steel member, and further having a second portion, substantially perpendicular to the first portion, with holes of a second hole pattern which are juxtaposed with holes of the hole pattern near the upper end of the first column steel member, the juxtaposed holes associated with the first corner connecting bracket being hereafter referred to as first corner juxtaposed holes;

a plurality of first corner fasteners received through respective first corner juxtaposed holes so as to fixedly connect the first corner connecting bracket to the first column steel member near its upper end and the first chord steel member near its lower end;

a second corner connecting bracket having a first portion with holes of a first hole pattern which are juxtaposed with holes of the hole pattern near the lower end of the second chord steel member, and further having a second portion, substantially perpendicular to the first portion of the second corner connecting bracket, with holes of a second hole pattern which are juxtaposed with holes of the hole pattern near the upper end of the second column steel member, the juxtaposed holes associated with the second corner connecting bracket being hereafter referred to as second corner juxtaposed holes;

a plurality of second corner fasteners received through respective second corner juxtaposed holes so as to fixedly connect the second corner connecting bracket to the second column steel member near its upper end and the second chord steel member near its lower end;

a peak connecting bracket having a first portion with holes of a hole pattern which are juxtaposed with holes of the hole pattern near the upper end of the first chord steel member and holes of the hole pattern near the upper end of the second chord steel member, the peak connecting bracket further having a second portion, substantially perpendicular to the first portion of the peak connecting bracket, with holes of a hole pattern which are juxtaposed with holes of the hole pattern near the upper end of the third column steel member, the juxtaposed holes associated with the peak connecting bracket being hereafter referred to as peak juxtaposed holes;

a plurality of peak fasteners received through respective peak juxtaposed holes so as to fixedly connect the peak connecting bracket to the second chord steel member near its upper end, the second chord steel member near its upper end, and the third column steel member near its upper end.

* * * * *